US009676598B1

(12) United States Patent
Schulte

(10) Patent No.: US 9,676,598 B1
(45) Date of Patent: Jun. 13, 2017

(54) GRAVITY ACTIVATED LIFTING CLAW

(71) Applicant: Anthony Joseph Schulte, Encino, CA (US)

(72) Inventor: Anthony Joseph Schulte, Encino, CA (US)

( * ) Notice: Subject to any disclaimer, the term of this patent is extended or adjusted under 35 U.S.C. 154(b) by 0 days.

(21) Appl. No.: 14/957,222

(22) Filed: Dec. 2, 2015

(51) Int. Cl.
*B66C 1/44* (2006.01)
*B66C 1/42* (2006.01)

(52) U.S. Cl.
CPC ..... *B66C 1/422* (2013.01); *B66C 1/442* (2013.01)

(58) Field of Classification Search
CPC ..... B66C 1/422; B66C 1/442; B66C 3/06
USPC ..... 294/110.1, 110.2
See application file for complete search history.

(56) References Cited

U.S. PATENT DOCUMENTS 460,883 A * 10/1891 Nugent ..... B23B 47/281 269/153
845,555 A 2/1907 Langley
1,065,056 A * 6/1913 Lawrence ..... B66C 1/422 294/106
1,129,664 A * 2/1915 Gilchrist et al. ..... B66C 3/04 294/110.1
2,286,071 A 6/1942 Dragan et al.
2,435,119 A 1/1948 Baker
2,629,627 A 2/1953 Stone
2,778,671 A * 1/1957 Langston ..... B66C 1/56 294/95
2,857,193 A * 10/1958 Heppenstall ..... B66C 1/32 294/106
3,942,834 A * 3/1976 Kawaguchi ..... B66C 1/64 294/106
5,056,845 A * 10/1991 Cook ..... B66C 1/442 294/118
5,755,476 A * 5/1998 Hosking ..... B66C 1/442 294/106
7,673,918 B2 3/2010 Cveykus
8,562,050 B1 * 10/2013 Basinger ..... B65G 7/12 294/110.1

* cited by examiner

*Primary Examiner* — Dean Kramer

(57) ABSTRACT

A gravity activated lifting claw for help in moving and gripping a wide range of objects of various sizes and shapes. The gravity activated lifting claw includes a link and slide structure that allows for configurations with varying number of gripping arms. The gravity activated claw is self-opening when the claw is slacked. The embodiments of the lifting claw are cheaply and easily configurable with a wide range of material handling machinery.

13 Claims, 9 Drawing Sheets

GRAVITY ACTIVATED LIFTING CLAW

BACKGROUND

Field of the Invention

The invention relates to the field of crane hooks, gripping members engaging only the external or internal surfaces, and gripping members applying frictional forces, namely CPC B66C 1/34, 1/42, 1/422, and 1/44.

The Problem to be Solved

There are a large range of categories of lifting devices available on the market which can assist in material handling and transportation. One example is a mechanical claw that requires a driving force to open or close it. These are typically driven by rods or cylinders and powered pneumatically, hydraulically, or electrically (solenoids). These mechanical claws have the ability to open and close at any position but generally cannot operate (open and close) through the force of gravity. One limitation of such a design is that installing mechanical claw systems are complex and must be considered in the initial installation of crane-type equipment. The mechanical claws driven by pneumatics, hydraulics, or electrics require additional infrastructure and are difficult to quickly change. For example, gantry and bridge cranes require festoon systems to supply hydraulics or electrical power. Adding a drop for the claw driving source becomes an engineering challenge for incorporation into something like a wire rope hoist or gantry crane. This leads to the problem of being unable to easily change the gripping mechanism utilized by such a mechanical claw system. In a situation where objects of different sizes and shapes need to be moved, this can be a problem because it is unlikely that the initially installed mechanical claw has the versatility to lift a wide range of objects.

The industry does offer some aftermarket lifting devices which are intended to be compatible with equipment such as cranes (all types—floor, gantry, jib, etc.), hoists, winches, and trolleys and can be installed after the purchase of the crane or other material handling machine. However, the aftermarket lifting devices available still fail to offer the versatility necessary to grip a large range of dissimilar objects.

While working for a former employer, the inventor was involved in a safety incident investigation. Some irregularly cut pieces of titanium were being moved and rotated for their next cuts on a vertical hydraulic band saw. These pieces did not have much available room to use existing devices such as lifting tongs or scissor lifting clamps. The cut pieces often slipped out of these devices due to their irregular shape. The cut pieces of titanium would range from 20 lbs-45 lbs. Moving these pieces by hand was acceptable under OSHA safety standards. The cut edge of titanium is extremely sharp, and the worker was wearing cut resistant gloves as a safety precaution. The combination of sharpness, heft and irregular shape caused a cut piece of titanium to slide out of his hands, cutting through the glove and slicing his hand open from index to pinky finger, requiring stitches. The inventor was on the accident investigation team and was responsible for analyzing the causes of the incident and creating a corrective action plan that would reduce material handling risk in the future. The team discussed a lifting tong that grabbed a piece by more than two sides. After extensive search, the team could not find a product that suited their needs. The team made safety adjustments for the process, but was puzzled by the fact that there were no gripping devices similar to the lifting tongs available on the market, that could grip from three or more sides to accommodate irregularly shaped objects.

BRIEF SUMMARY

As a result of the safety incident discussed above, the illustrated embodiments of the present invention were devised to prevent similar injuries in the future. The illustrated embodiments of the present invention provide for a lifting claw. In one embodiment the lifting claw is gravity actuated. In this embodiment the lifting claw includes a plurality of arm assemblies. The plurality of arm assemblies are movable through a link and slide structure which operates along a shaft. The embodiment is designed to be compatible with material handling machinery, including cranes, hoists, winches, and trolleys. The device is engaged by the upward pulling force from a material handling machine. The engaging force of gravity causes the device to close. An object placed in the plurality of arm assemblies is gripped by the closure of the arm assemblies. The plurality of arm assemblies are designed so that the effective vector component force of the object's gravity is less than the upward and closed frictional or engagement force of the arm assemblies with the object, resulting in the object being safely locked in the plurality of arm assemblies. To unlock the plurality of arm assemblies, the object is placed on a resting surface. As the upward force applied to the lifting claw is decreased, the lifting claw disengages from the object, releasing it.

In one embodiment there is a singular slide structure that controls the movement of all of the plurality of arm assemblies.

In another embodiment each of the plurality of arm assemblies has a corresponding slide structure which allows for independent movement of each one of the plurality of arm assemblies.

In another embodiment the lifting claw includes inserts which allow the plurality of arm assemblies to be selectively attached, and unattached, to the lifting claw.

These and other aspects of the illustrated embodiments of the present invention will be more apparent from the following description.

In summary, the illustrated embodiments include an apparatus for gripping an object which includes a shaft having a longitudinal axis and having a lower portion, a movable slide assembly movable along the longitudinal axis of the shaft, a fixed slide assembly which is fixed to the lower portion of the shaft; and a plurality of arm assemblies. Each one of the plurality of arm assemblies include a rigid arm extending from the movable slide assembly, a first link rotatably coupled to the rigid arm, a second link rotatably coupled to each of the first link and the fixed slide assembly, a gripping arm coupled to one of the first or second links and extending therefrom and a gripping interface corresponding to the gripping arm that facilitates gripping of the object, whereby a movement of the movable slide assembly on the shaft away from the fixed slide assembly causes each of the gripping interface to move towards the longitudinal axis and the object below the shaft, and the movement of the movable slide assembly towards the fixed slide assembly causes each of the gripping interface to move away from the object.

In one embodiment the apparatus further includes a hook attached to an upper portion of the shaft.

In another embodiment the hook is compatible with equipment selected from a group consisting of cranes, hoists, winches, and trolleys.

In yet another embodiment the apparatus further includes a hook assembly attached to the movable slide assembly.

In one embodiment the shaft is substantially cylindrical in shape.

In another embodiment the gripping interface utilizes a suction technology to facilitate gripping.

In yet another embodiment the gripping interface utilizes a high friction rubber to facilitate gripping.

In one embodiment the gripping interface utilizes a grooved fade to facilitate gripping.

In another embodiment the apparatus is designed for hand held use.

The illustrated embodiments also include a gravity actuated apparatus for gripping an object which includes a shaft having a longitudinal axis, a plurality of arm assemblies attached to the shaft, each one of the plurality of arm assemblies movable via a link and slide structure, and a plurality of gripping interfaces, each corresponding to one of the plurality of arm assemblies, whereby the apparatus is actuated by a pulling force, the pulling force causing the plurality of gripping interfaces to move toward the object in a "closed" position allowing for the object to be gripped and then lifted, whereby the object is released from the plurality of gripping interfaces when the pulling force is removed.

The apparatus further includes a hook assembly attached to an upper portion of the shaft.

In another embodiment the hook assembly is compatible with equipment selected from a group consisting of cranes, hoists, winches, and trolleys.

In yet another embodiment the shaft is substantially cylindrical in shape.

In one embodiment the plurality of gripping interfaces utilizes a suction technology to facilitate gripping.

In another embodiment the plurality of gripping interfaces utilizes a high friction rubber to facilitate gripping.

In still another embodiment the plurality of gripping interfaces utilizes a grooved face to facilitate gripping.

In one embodiment the apparatus is designed for hand held use.

In another embodiment the link and slide structure allows for independent movement of each one of the plurality of arm assemblies.

The illustrated embodiments also include an apparatus for gripping an object which in turn includes a shaft having a longitudinal axis and having a lower portion, a movable slide assembly movable along the longitudinal axis of the shaft, a plurality of upper arm inserts associated with the movable slide assembly, a fixed slide assembly which is fixed to the lower portion of the shaft, a plurality of lower arm inserts associated with the fixed slide assembly, and a plurality of arm assemblies. Each one of the plurality of arm assemblies further includes a first link selectively attachable to one of the plurality of upper arm inserts, and when attached rotatably coupled to the movable slide assembly, a second link rotatably coupled to the first link and selectively attachable to one of the plurality of lower arm inserts, a gripping arm coupled to one of the first or second links and extending therefrom, and a gripping interface corresponding to the gripping arm that facilitates gripping of the object, whereby movement of the movable slide assembly along the shaft away from the fixed slide assembly causes the gripping interface of each of the plurality of arm assemblies, which are currently attached, to move towards the longitudinal axis and the object below the shaft, and movement of the movable slide assembly towards the fixed slide assembly causes the gripping interface of each of the plurality of arm assemblies, which are currently attached, to move away from the object.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE SEVERAL VIEWS OF THE DRAWINGS

To easily identify the discussion of any particular element or act, the most significant digit or digits in a reference number refer to the Fig. number in which that element is first introduced.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION

Figure 1:
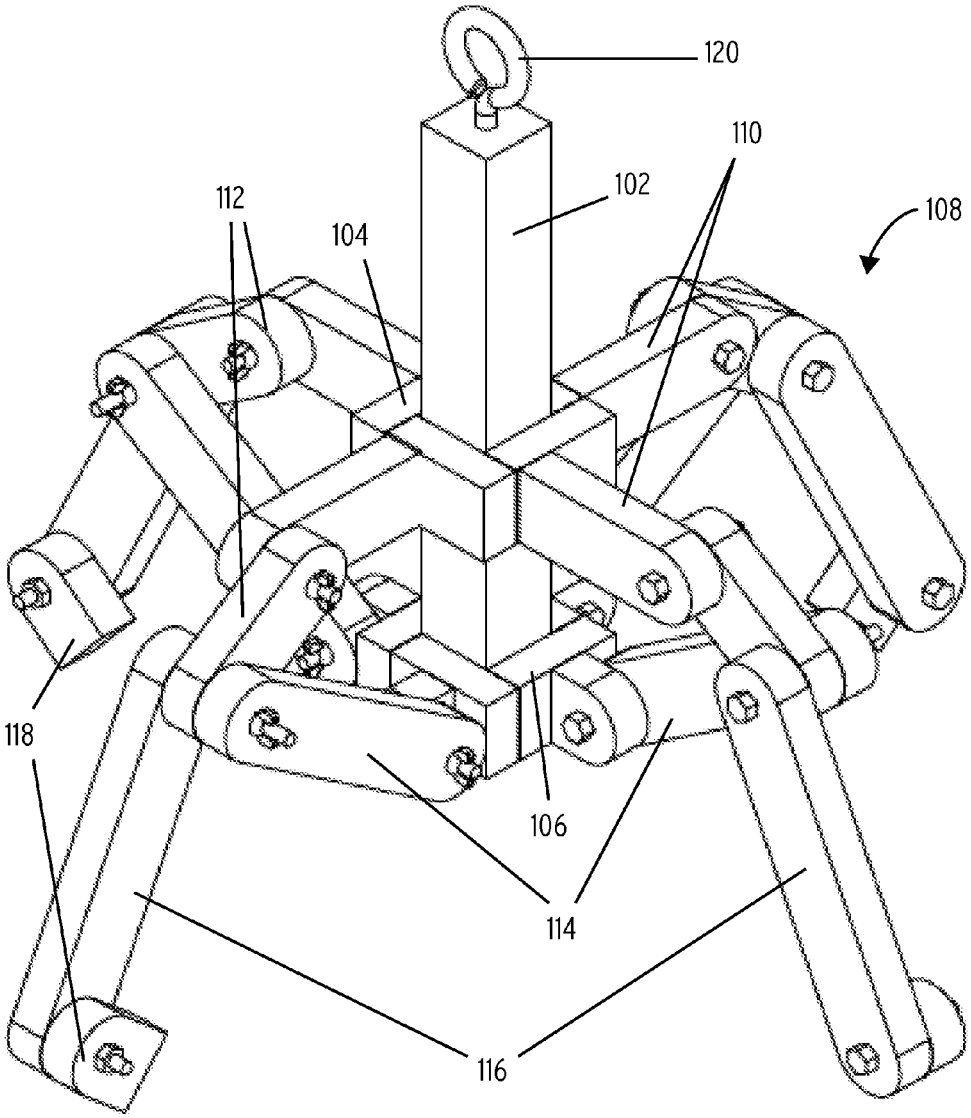
FIG. 1 is an isometric view of a gripping claw in accordance with an embodiment of the subject matter.

FIG. 1 illustrates an aspect of one embodiment. The embodiment includes a shaft 102 with a longitudinal axis and an upper portion and a lower portion. A hook 120 is mounted at the upper portion of the shaft 102. The hook 120 is designed to hook onto cranes, hoists, winches, and trolleys. However, the embodiment is not limited to use with the listed equipment. The hook 120 can be designed to be used in conjunction with a single type of listed equipment, a subset of the list, or the entire list. Furthermore, the hook 120 is designed to be compatible with a specific model of machinery or a range of models and designs. This language is not intended to limit the uses of the hook 120 but to provide examples of some potential uses of the hook 120. One envisioned use of this embodiment is as an aftermarket lifting device, sometimes described as a "below-the-hook lifting accessory" within the industry. This embodiment also includes a movable slide assembly 104 which is movable along the longitudinal axis of the shaft 102. This embodiment further comprises a fixed slide assembly 106 which is fixed to the lower portion of the shaft 102. In addition, there are a plurality of arm assemblies 108, with each arm assembly 108 rotatably attached at the movable slide assembly 104 and rotatably attached at the fixed slide assembly 106. FIG. 1 shows an embodiment with four arm assemblies 108 but the invention is not so limited. The plurality of arm assemblies 108 could include any number of arm assemblies 108 greater than one. Although not every conceivable number of arm assemblies 108 are illustrated, one skilled in the art could easily envision how the illustrated embodiment could be configured to accommodate any number of arm assemblies 108.

In the illustrated embodiment the shaft 102 has a substantially square cross section, however, this is not important to the concept of the invention. The shaft 102 could be any number of shapes, with a number of cross sectional shapes, even cross sectional shapes that are not uniform along the length of the longitudinal axis. In another preferred embodiment the shaft is substantially cylindrical.

Each of the arm assemblies 108 in the embodiment illustrated in FIG. 1 are comprised of a rigid arm 110 which extends from the movable slide assembly 104, a first link 112 which is rotatably coupled to the rigid arm 110, a second link 114 which is rotatably coupled to both the first link 112 and rotatably coupled the fixed slide assembly 106, a gripping arm 116 which extends from either the first link 112 or second link 114, and a gripping interface 118 corresponding to the gripping arm 116. In this embodiment the gripping arm 116 extends from the region where the first link 112 and second link 114 are coupled, however, the gripping arm 116 could extend from other parts of either the first link 112 or second link 114. One skilled in the art could easily envision a configuration of the illustrated embodiment that would accomplish the intended purpose of the embodiment with the gripping arm 116 extending from different places along either the first link 112 or second link 114 at various angles and orientations. Furthermore, the illustrated embodiment demonstrates a construction where the gripping arm 116 is a separate piece from either the first link 112 or second link 114, but the invention is not so limited. The gripping arm 116 could form a contiguous or integral piece with either the first link 112 or the second link 114.

The illustrated embodiment of FIG. 1 is intended to be used to grip an object and to facilitate in material handling. When the movable slide assembly 104 moves away from the fixed slide assembly 106, the mechanical motion of the first links 112 and second links 114 causes the gripping interfaces 118 to move toward the longitudinal axis of shaft 102 and the object to be gripped. Conversely, when the movable slide assembly 104 moves toward the fixed slide assembly 106, the gripping interfaces 118 move away from the longitudinal axis of shaft 102. One envisioned use of the illustrated embodiment is as a device compatible with material handling machinery which includes, but is not limited to, cranes, hoists, winches, and trolleys. In this capacity the illustrated embodiment would engage with the hook of the material handling machinery at the hook 120 of the illustrated embodiment. Some, or all, of the gripping interfaces 118 would be placed against the object to be moved. The gripping interfaces 118 might use suction technology, a grooved face, or high friction rubber to facilitate the gripping of the object. When the gripping interfaces 118, or a subset of the gripping interfaces 118, are engaged with the object, it can then be lifted. The weight of the object will force the engaged gripping interfaces 118 to clamp onto the object and the area of engagement with the object will provide enough friction force to allow the lifting of the object. When the object is placed on a surface that supports its weight, the friction force will be removed thus allowing the gripping interfaces 118 to be disengaged from the object.

Figure 2:
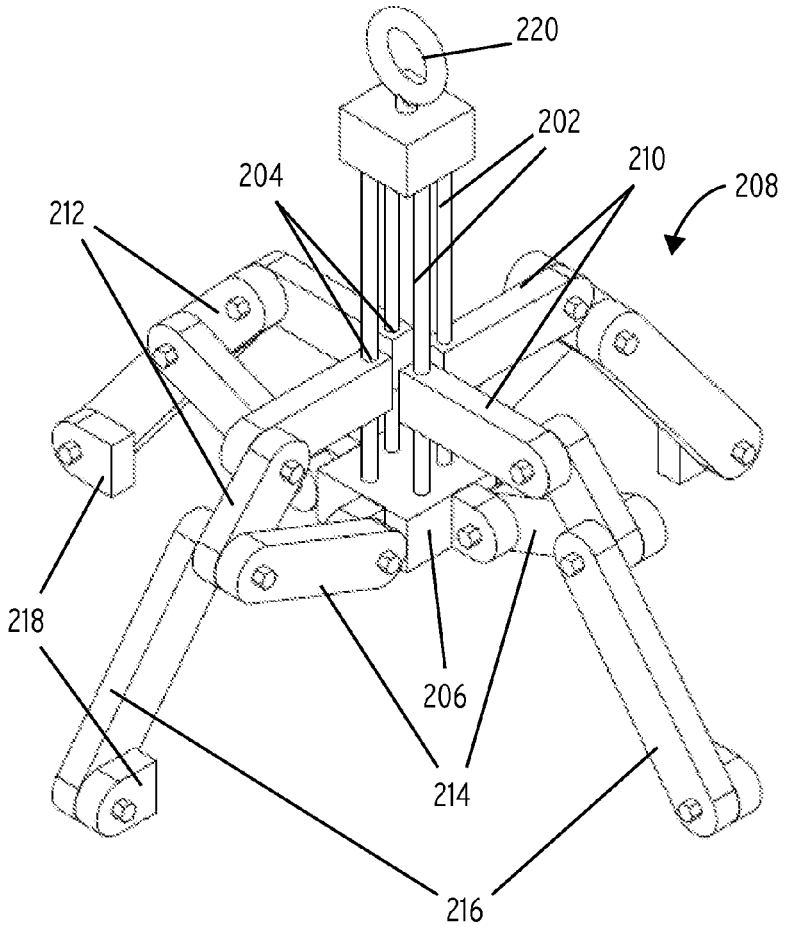
FIG. 2 is an isometric view of a gripping claw with a plurality of arm assemblies with each of the plurality of arm assemblies attached to its own slide structure in accordance with an embodiment of the subject matter.

FIG. 2 illustrates an aspect of the subject matter in accordance with another embodiment. The embodiment illustrated in FIG. 2 operates similarly to the operation of the embodiment illustrated in FIG. 1, except that in the FIG. 2 embodiment there are a plurality of shafts 202 and a plurality of movable slide assemblies 204. The number of movable slide assemblies 204, and the number of shafts 202, corresponds to the number of arm assemblies 208. In the illustrated embodiment there are four shafts 202, four movable slide assemblies 204, and four arm assemblies 208. However, this embodiment is not intended to limit the invention to four shafts 202, four movable slide assemblies 204, or four arm assemblies 208. One skilled in the art could easily envision a design with any number of shafts 202, movable slide assemblies 204, and arm assemblies 208 based on the provided embodiment. Like the embodiment illustrated in FIG. 1, the plurality of arm assemblies 208 are further comprised of a rigid arm 210, first link 212, second link 214, gripping arm 216, and gripping interface 218. Furthermore, each of the shafts 202 have an upper portion and a lower portion. The lower portion of each shaft 202 is fixed to the fixed slide assembly 206. The upper portion of each shaft 202 is attached to a hook assembly 220.

Figure 3:
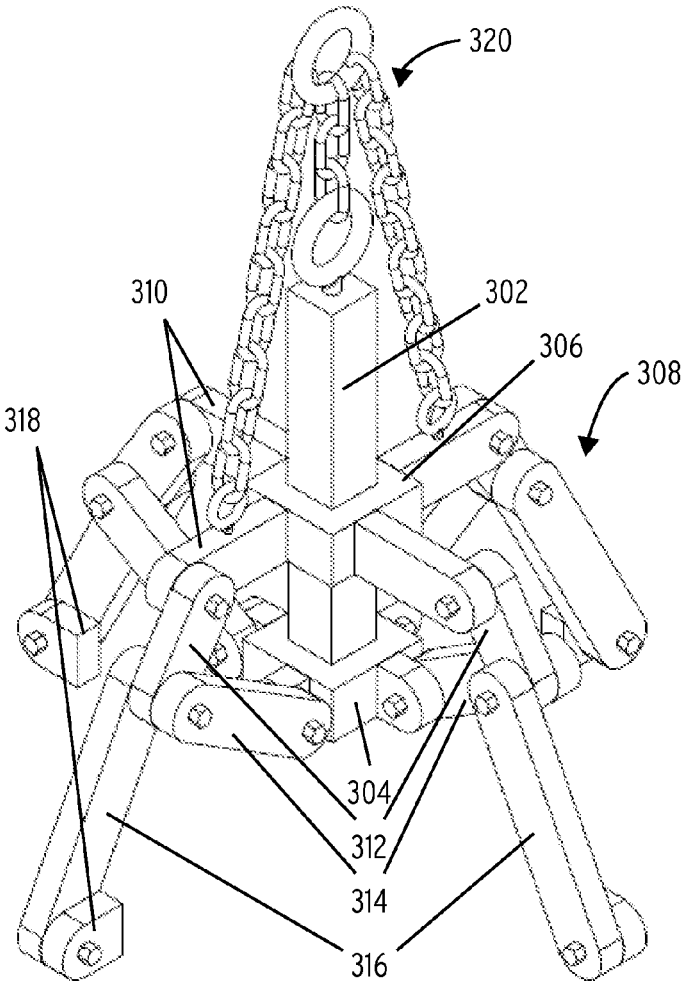
FIG. 3 is an isometric view of a gripping claw with a hook assembly attached to a rigid arms in accordance with an embodiment of the subject matter.

In the embodiment of FIG. 1 the movement of the plurality of arm assemblies 108 is dictated by the singular movable slide assembly 104, so that when one gripping arm 116 moves, all of the gripping arms 116 move. The embodiment of FIG. 2 allows for independent movement of each arm assembly 208 because each arm assembly 208 has its own independent movable slide assembly 204. For some objects this will allow for more gripping interfaces 218 to come into contact with the object which would lead to an increased surface area to grip the object with more gripping points FIG. 3 illustrates an aspect of another embodiment. In this embodiment the hook 120 from FIG. 1 is replaced by a hook assembly 320 which attaches directly to either the rigid arms 310 or the fixed slide assembly 306. In the FIG. 3 illustration the hook assembly attaches at two different rigid arms 310; however, the embodiment would operate as well if the hook assembly 320 were attached to the fixed slide assembly 306 instead. In addition, the illustrated embodiment shows only three attachments of the hook assembly 320 to the rest of the structure but the envisioned use allows for a singular attachment point or many more. The hook assembly 320 functions similarly to hook 120 from the illustrated embodiment in FIG. 1 in that it is intended to engage with material handling machinery.

Like the embodiment illustrated in FIG. 1, the plurality of arm assemblies 308 are further comprised of a rigid arm 310, first link 312, second link 314, gripping arm 316, and gripping interface 318. Furthermore, the shaft 302 has an upper portion and a lower portion. The upper portion of the shaft 302 is fixed to the fixed slide assembly 306. The upper portion of the shaft 302 is attached to the hook assembly 320. Unlike the embodiment illustrated in FIG. 1, the fixed slide assembly 306 is attached to the upper portion of the shaft 302 and the movable slide assembly 304 is associated with the lower portion of the shaft 302.

Figure 4:
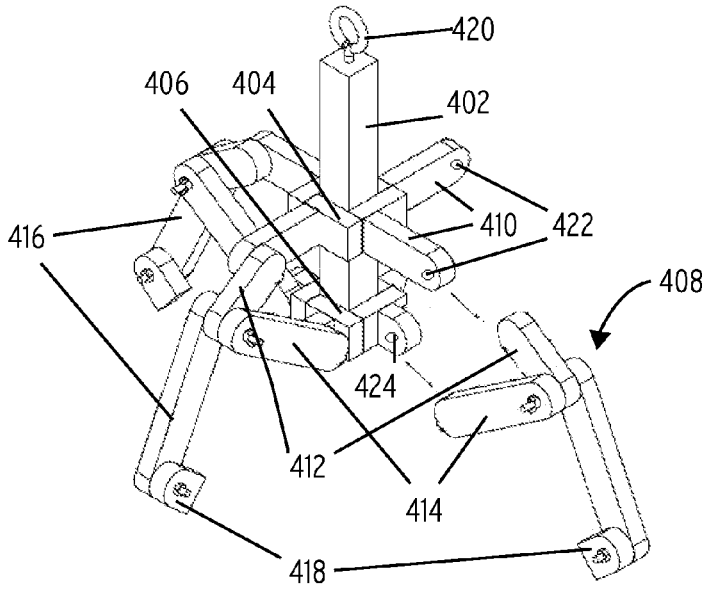
FIG. 4 is an isometric view of a gripping claw with a plurality of arm assemblies which are selectively attachable in accordance with an embodiment of the subject matter.

FIG. 4 illustrates another embodiment where the plurality of arm assemblies 408 are selectively attachable to the rest of the structure. In this embodiment there are a plurality of upper arm inserts 422 and a plurality of lower arm inserts 424. The plurality of upper arm inserts 422 correspond with the movable slide assembly. Unlike some of the other embodiments, in this embodiment the rigid arms 410 are a part of the movable slide assembly 404, not a part of the arm assembly 408. The plurality of lower upper arm inserts 424 correspond to the fixed slide assembly 406. Each arm assembly 408 is selectively attachable at a corresponding upper arm insert 422 and a corresponding lower arm insert 424. Once the user selectively attaches the number of arm assemblies that the user desires, this embodiment operates in substantially the same way as the embodiment illustrated in FIG. 1.

The plurality of arm assemblies 408 are further comprised of a first link 412, second link 414, gripping arm 416, and gripping interface 418. Furthermore, the shaft 402 has an upper portion and a lower portion. The lower portion of the shaft 402 is fixed to the fixed slide assembly 406. The upper portion of the shaft 402 is attached to the hook 420. The movable slide assembly 404 is further comprised of a plurality of rigid arms 410.

Figure 5:
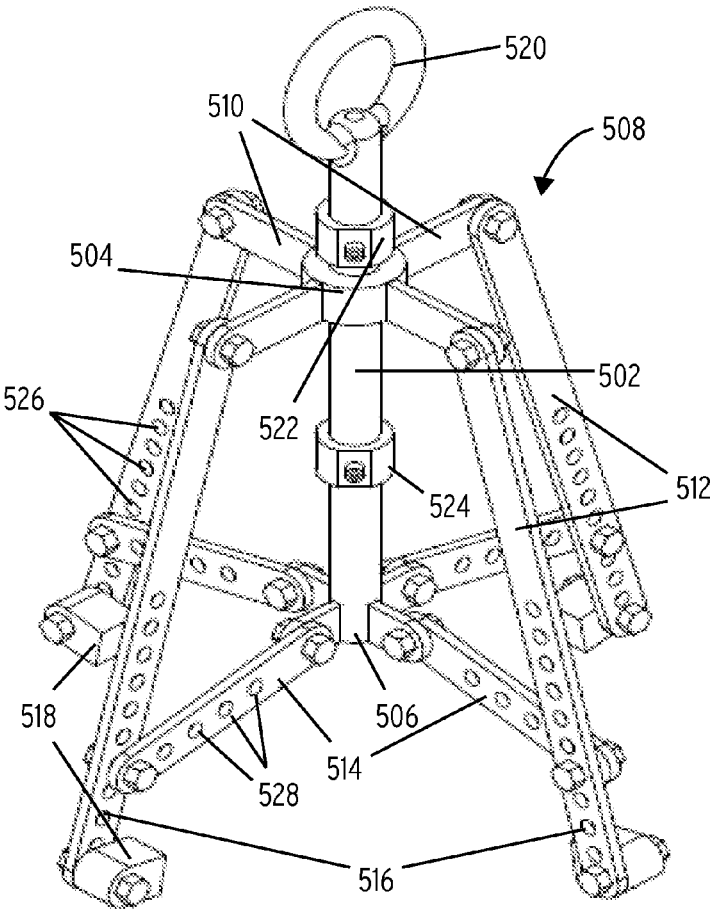
FIG. 5 is an isometric view of a gripping claw with adjustable arm assemblies and stops that dictate the range of motion of the link and slide structure in accordance with an embodiment of the subject matter.
Figure 7:
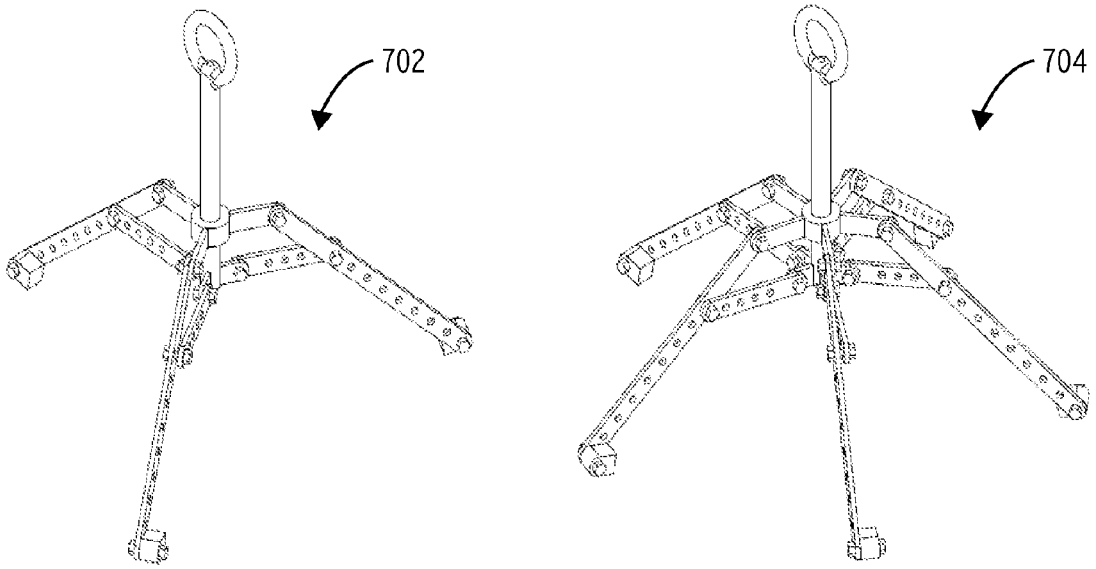
FIG. 7 is an isometric view of a gripping claw with three arm assemblies and a gripping claw with five arm assemblies in accordance with two embodiments of the subject matter.

FIG. 5 illustrates an aspect of the subject matter in accordance with another embodiment. The embodiment includes a shaft 502 with a longitudinal axis and an upper portion and a lower portion. A hook 520 is mounted at the upper portion of the shaft 502. The hook 520 is designed to hook onto cranes, hoists, winches, and trolleys. However, the embodiment is not limited to use with the listed equipment. The hook 520 can be designed to be used in conjunction with a single type of listed equipment, a subset of the list, or the entire list. Furthermore, the hook 520 is designed to be compatible with a specific model of machinery or a range of models and designs. This language is not intended to limit the uses of the hook 520 but to provide examples of some potential uses of the hook 520. One envisioned use of this embodiment is as an aftermarket lifting device, sometimes described as a "below-the-hook lifting accessory" within the industry. This embodiment also includes a movable slide assembly 504 which is movable along the longitudinal axis of the shaft 502. This embodiment further comprises a fixed slide assembly 506 which is fixed to the lower portion of the shaft 502. In addition, there are a plurality of arm assemblies 508, with each arm assembly 508 rotatably attached at the movable slide assembly 504 and rotatably attached at the fixed slide assembly 506. FIG. 5 shows an embodiment with four arm assemblies 508 but the invention is not so limited. The plurality of arm assemblies 508 could include any number of arm assemblies 508 greater than one, as illustrated by FIG. 7 which illustrates an embodiment with three arm assemblies 702 and an embodiment with five arm assemblies 704. Once again, these embodiments are not meant to be restrictive but to illustrate the diversity of the subject matter.

In the illustrated embodiment of FIG. 5 the shaft 502 has a substantially cylindrical shape, however, this is not important to the concept of the invention. The shaft 502 could be any number of shapes, with a number of cross sectional shapes, even cross sectional shapes that are not uniform along the length of the longitudinal axis.

Each of the arm assemblies 508 in the embodiment illustrated in FIG. 5 are comprised of a rigid arm 510 which extends from the movable slide assembly 504, a first link 512 which is rotatably coupled to the rigid arm 510, a second link 514 which is rotatably coupled to both the first link 512 and rotatably coupled to the fixed slide assembly 506, a gripping arm 516 which extends from either the first link 512 or second link 514, and a gripping interface 518 corresponding to the gripping arm 516. In the embodiment illustrated in FIG. 5 the first link 512 and the gripping arm 516 are formed by a singular and linear component, however, the subject matter is not so limited. The first link and gripping arm could be separate component parts as demonstrated in the embodiment illustrated in FIG. 1. Additionally, the first link and gripping arm are not limited to a linear configuration.

Figure 6:
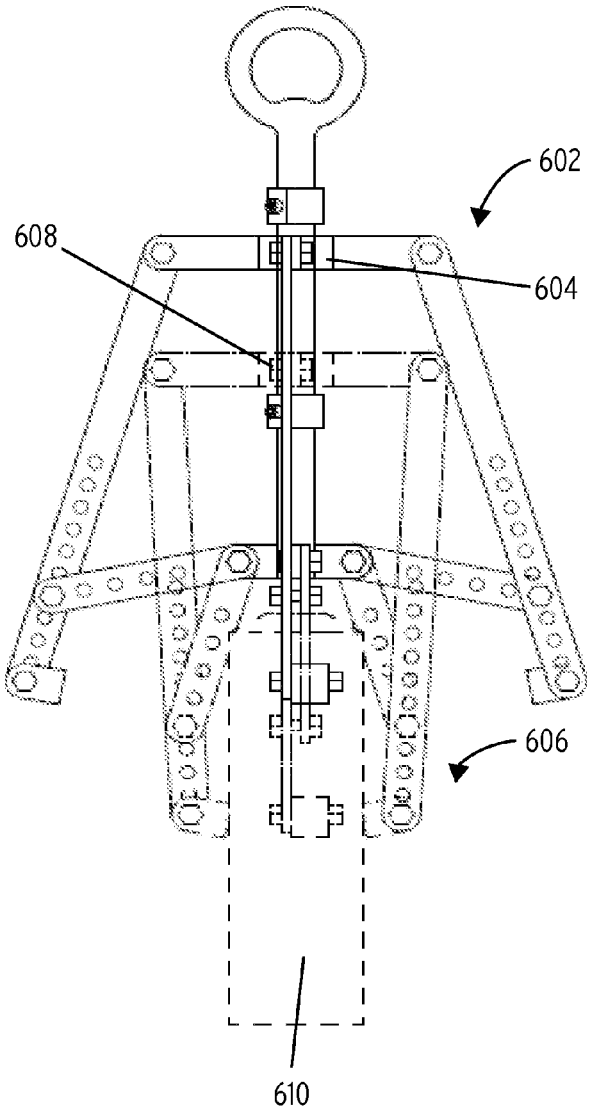
FIG. 6 is a front view demonstrating an open position and closed position of a gripping claw in accordance with an embodiment of the subject matter.

The illustrated embodiment of FIG. 5 is intended to be used to grip an object and to facilitate in material handling. When the movable slide assembly 504 moves toward the fixed slide assembly 506, the mechanical motion of the first links 512 and the second links 514 causes the gripping interfaces 518 to move toward the longitudinal axis of shaft 502 and the causes the object to be gripped. Conversely, when the movable slide assembly 504 moves away from the fixed slide assembly 506, the gripping interfaces 518 move away from the longitudinal axis of shaft 502 and to release the object. This application is illustrated in FIG. 6. FIG. 6 shows the arm assemblies in an open position 602 when the assembly is moved away from the fixed slide assembly 604. FIG. 6 also shows the arm assemblies in a closed portion 606 when the movable slide assembly is moved toward the fixed slide assembly 608. When in the closed position 606, the gripping interfaces cause the object 610 to be gripped. Note that this mechanical motion is different than in the illustrated embodiment of FIG. 1. In FIG. 1 the closed position is formed when the moveable slide assembly 104 is moved away from the fixed slide assembly 106 and, conversely, the open position is formed when the movable slide assembly 104 is moved toward the fixed slide assembly 106.

In addition the illustrated embodiment of FIG. 5 may include an upper stop 522, a lower stop 524, or both. The upper stop 522 and lower stop 524 are used to dictate the range of motion of the movable slide assembly 504, which in turn dictates the range of motion of the arm assemblies 508. FIG. 6 illustrates a fully closed position 606 where the movable slide assembly comes into contact with the lower stop 608 and the gripping interfaces grip the object 610. It also illustrates a fully open position 602 where the movable slide assembly comes into contact with the upper stop 604. The upper stop 522 may be fixed to the shaft 502 as illustrated by the embodiment of FIG. 5 or it may be selectively attachable to the shaft 502 at various positions along the shaft 502 so that the range of motion of the arm assemblies 508 can be adjusted by the user. The lower stop 524 may likewise be fixed to the shaft 502 as illustrated by the embodiment of FIG. 5 or selectively attachable by the user.

The illustrated embodiment of FIG. 5 also includes a plurality of first link adjustment hole 526 and a plurality of second link adjustment hole 528. These holes allow the user to selectively adjust the attachment point between the first link 512 and second link 514 for each of the plurality of arm assemblies 508.

One envisioned use of the illustrated embodiment is as a device compatible with material handling machinery which includes, but is not limited to, cranes, hoists, winches, and trolleys. In this capacity the illustrated embodiment would engage with the hook of the material handling machinery at the hook 520 of the illustrated embodiment. Some, or all, of the gripping interfaces 518 would be placed against the object to be moved. The gripping interfaces 518 might use suction technology, a grooved face, or high friction rubber to facilitate the gripping of the object. When the gripping interfaces 518, or a subset of the gripping interfaces 518, are engaged with the object, it can then be lifted. The weight of the object will force the engaged gripping interfaces 518 to clamp onto the object and the area of engagement with the object will provide enough friction force to allow the lifting of the object. When the object is placed on a surface that supports its weight, the friction force will be removed thus allowing the gripping interfaces 518 to be disengaged from the object. In this way the embodiment is gravity actuated.

Figure 8:
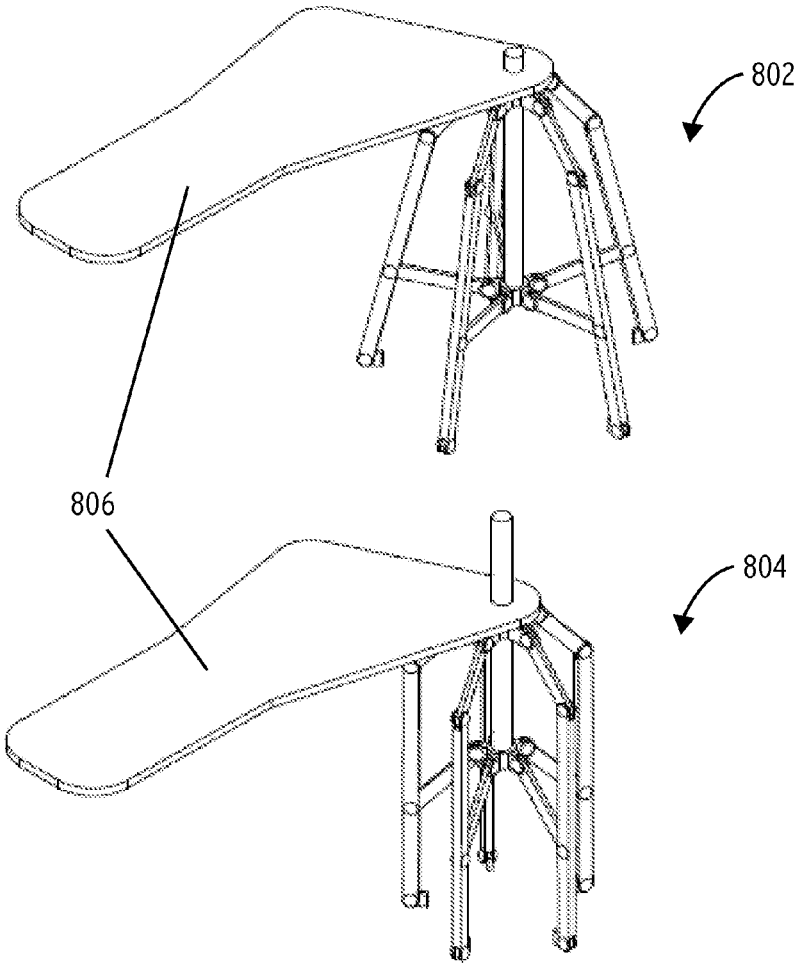
FIG. 8 is an isometric view of a gripping claw meant for handheld use showing two positions of operation in accordance with an embodiment of the subject matter.

FIG. 8 illustrates another embodiment of an aspect of the subject matter. This embodiment operates in a very similar way to the embodiment illustrated in FIG. 1 but this embodiment is meant for handheld use rather than use in conjunction with material handling machinery. However, there are differences in operation beyond the intended user. In the illustrated embodiment of FIG. 8 the open position 802 is formed when the movable slide assembly is moved away from the fixed slide assembly. Conversely, the closed position 804 is created when the movable slide assembly is moved toward the fixed slide assembly. In this way the embodiment of FIG. 8 operates similarly to the embodiment of FIG. 5.

The embodiment of FIG. 8 is distinguishable from both the embodiment of FIG. 1 and the embodiment of FIG. 5 in that it consists of three links rather than two links. In the embodiment of FIG. 8 the gripping arm also acts as a link. This difference in design does not play a crucial role in the operation of the device. The two link design could easily be used in a design intended for handheld use, and the three link design could easily be used for a design to be implemented in conjunction with material handling machinery.

Figure 9:
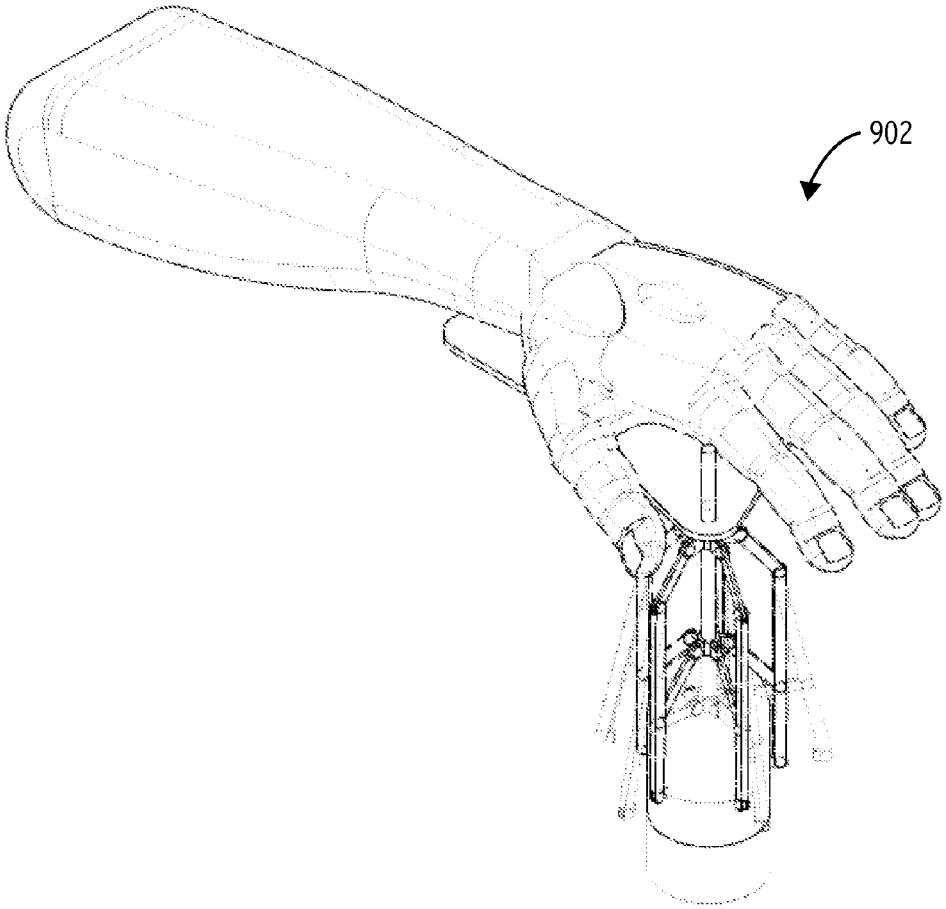
FIG. 9 is an isometric view of a gripping claw meant for handheld use showing the object to be gripped in accordance with an embodiment of the subject matter.

The embodiment of FIG. 8 also includes a grasping mechanism 806. The embodiment of FIG. 8 illustrates an irregular shape to be used as the grasping mechanism 806 but the subject matter is not so limited. One skilled in the art could imagine any number of possible shapes that could function as the grasping mechanism. FIG. 9 illustrates the embodiment of FIG. 8 in use with a person's hand 902.

The grasping mechanism 806 could also include straps to interact with the user's arm or hand. The straps could wrap around the user's arm or hand and be tightened to secure the grasping mechanism to the user. One skilled in the art could envision other ways of securing the grasping mechanism 806 to the user.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

What is claimed is:

1. An apparatus for gripping an object comprising:

a shaft having a longitudinal axis and having a lower portion;

a movable slide assembly movable along the longitudinal axis of the shaft;

a fixed slide assembly which is fixed to the lower portion of the shaft;

a hook assembly attached to the movable slide assembly; and a plurality of arm assemblies, each one of the plurality of arm assemblies further comprising:

a rigid arm extending from the movable slide assembly;

a first link rotatably coupled to the rigid arm;

a second link rotatably coupled to each of the first link and the fixed slide assembly;

a gripping arm coupled to one of the first or second links and extending therefrom; and a gripping interface corresponding to the gripping arm that facilitates gripping of the object;

whereby a movement of the movable slide assembly on the shaft causes each of the gripping interface to move towards the longitudinal axis and the object below the shaft, and the movement of the movable slide assembly in the opposite direction causes each of the gripping interface to move away from the object.

2. The apparatus of claim 1, wherein the shaft is substantially cylindrical in shape.

3. The apparatus of claim 1, wherein the gripping interface utilizes a high friction rubber to facilitate gripping.

4. The apparatus of claim 1, wherein the apparatus is designed for hand held use.

5. The apparatus of claim 1, further comprising a hook attached to an upper portion of the shaft.

6. The apparatus of claim 5, wherein the hook is compatible with equipment selected from a group consisting of cranes, hoists, winches, and trolleys.

7. A gravity actuated apparatus for gripping an object comprising:

a shaft having a longitudinal axis;

a plurality of arm assemblies attached to the shaft, each one of the plurality of arm assemblies movable via a link and slide structure; and a plurality of gripping interfaces, each corresponding to one of the plurality of arm assemblies;

where each one of the plurality of arm assemblies is independently movable via a link and slide structure from other ones of the plurality of arm assemblies;

whereby the apparatus is actuated by a pulling force, the pulling force causing the plurality of gripping interfaces to move toward the object in a closed position allowing for the object to be gripped and then lifted, whereby the object is released from the plurality of gripping interfaces when the pulling force is removed.

8. The apparatus of claim 7, further comprising a hook assembly attached to an upper portion of the shaft.

9. The apparatus of claim 8, wherein the hook assembly is compatible with equipment selected from a group consisting of cranes, hoists, winches, and trolleys.

10. The apparatus of claim 7, wherein the shaft is substantially cylindrical in shape.

11. The apparatus of claim 7, wherein the plurality of griping interfaces utilizes a high friction rubber to facilitate gripping.

12. The apparatus of claim 7, wherein the apparatus is designed for hand held use.

13. A gravity actuated apparatus for gripping an object comprising:

a shaft having a longitudinal axis;

a plurality of arm assemblies attached to the shaft, each one of the plurality of arm assemblies movable via a link and slide structure; and a plurality of gripping interfaces, each corresponding to one of the plurality of arm assemblies;

wherein the link and slide structure allows for independent movement of each one of the plurality of arm assemblies;

whereby the apparatus is actuated by a pulling force, the pulling force causing the plurality of gripping interfaces to move toward the object in a closed position allowing for the object to be gripped and then lifted, whereby the object is released from the plurality of gripping interfaces when the pulling force is removed.

* * * * *